United States Patent [19]

Forte

[11] 3,978,801

[45] Sept. 7, 1976

[54] BALL BEARING LOOPER DRIVE

[75] Inventor: Anthony D. Forte, Chicago, Ill.

[73] Assignee: Union Special Corporation, Chicago, Ill.

[22] Filed: July 9, 1975

[21] Appl. No.: 594,394

[52] U.S. Cl. ..... 112/176; 308/178

[51] Int. Cl.[2] ..... D05B 1/24; D05B 57/30; F16C 35/06

[58] Field of Search ..... 112/176, 199, 200, 215, 112/220; 308/178, 188, 189 R, 189 A, 199

[56] References Cited

UNITED STATES PATENTS

| | | | |
|---|---|---|---|
| 1,716,095 | 6/1929 | Warner | 308/178 X |
| 2,624,856 | 1/1953 | Younger | 112/220 X |
| 3,071,421 | 1/1963 | Jones et al. | 308/178 |
| 3,104,553 | 9/1963 | Traeder | 308/178 X |
| 3,361,101 | 1/1968 | Roth | 112/176 |

FOREIGN PATENTS OR APPLICATIONS

| | | | |
|---|---|---|---|
| 1,153,177 | 9/1957 | France | 308/178 |
| 876,791 | 5/1953 | Germany | 308/178 |

*Primary Examiner*—Werner H. Schroeder
*Attorney, Agent, or Firm*—John A. Schaerli; John W. Harbst

[57] ABSTRACT

Force is delivered from a looper drive crank to a nut and bolt assembly having clamped thereto the inner races of first and second bearing sets. A spacer separates the bearing sets. The outer races of the bearing sets are press fit into the bore of a housing from which force is transmitted to a looper link.

5 Claims, 4 Drawing Figures

10
12
14
16
18
20
22
24
26
28
30
32
34
35
36
38
40
42
44
46
48
50
51
56
66
68

BALL BEARING LOOPER DRIVE

This invention relates to blindstitch sewing machines involving a looper mechanism connected to a driving means and more particularly to a ball bearing force transfer means connecting said looper mechanism to said driving means.

Blindstitch sewing machines and looper mechanisms of the above-mentioned are well known in the art. One type of mechanism of this character is shown in the patent to Roth, U.S. Pat. No. 3,361,101 granted Jan. 2, 1968 and in a patent to Mueller, U.S. Pat. No. 2,588,274 granted Mar. 4, 1952. Among other things, these patents relate to mechanisms for connecting the looper mechanism to the driving means. Such mechanisms are quite complicated in that the looper mechanism is given compound motions, including a longitudinal reciprocatory movement, an angular oscillatory movement and pivotal movements.

Various difficulties have been encountered in the operation of the force transfer means linking the driving means and the looper mechanism. These difficulties are aggravated when attempts have been made to speed up the operation of the machine. Because of the number of moving parts involved in prior art force transfer means, vibration and undesirable noises are generated in the course of operation of the mechanism. Additionally, excessive wear occurs on various bearing surfaces. The size of some prior art devices also, undoubtedly causes inertia problems while the excessive number of parts substantially complicates the assemblage thereof.

It is therefore, an object of this invention to provide a small compact force transfer means having a low inertia. Yet another object of this invention is to provide a force transfer means having a low center of gravity to facilitate input and output of forces. Another object of this invention is to provide a force transfer means wherein which force from the input means to the output means is through ball bearing sets. Still another object of this invention is to provide a force transfer means having bearing sets spread apart to increase stability. Another object of this invention is to provide a force transfer means easily assembled and having the inner races of the bearing sets clamped to the force output means whereby they can float with respect thereto, within a predetermined space.

The invention herein disclosed includes a ball bearing force transfer means securing the looper drive crank to the looper rod means. The force transfer means has a bore therethrough and a looper rod connection means centrally located on one side thereof. First and second bearing set means are horizontally or laterally spaced apart within the bore to the maximum extent; their outer races being press fit to the inside of the bore. A bearing spacer is provided in the bore between the two bearing sets. A nut and bolt means passes through the bearing sets and the spacer, and secures the force transfer means to the looper drive crank. The nut and bolt means as well as the bearing spacer means are provided with small shoulders whereby only the inner race of the bearing sets are engaged. That is, there is nothing directly securing either the housing to the inner race of the bearing sets other than the free floatable bearings existing therebetween.

With the foregoing features and advantages of the invention in mind, a preferred embodiment thereof will now be described in detail. In reference to the accompanying drawings, of which;

Figures 1, 4:
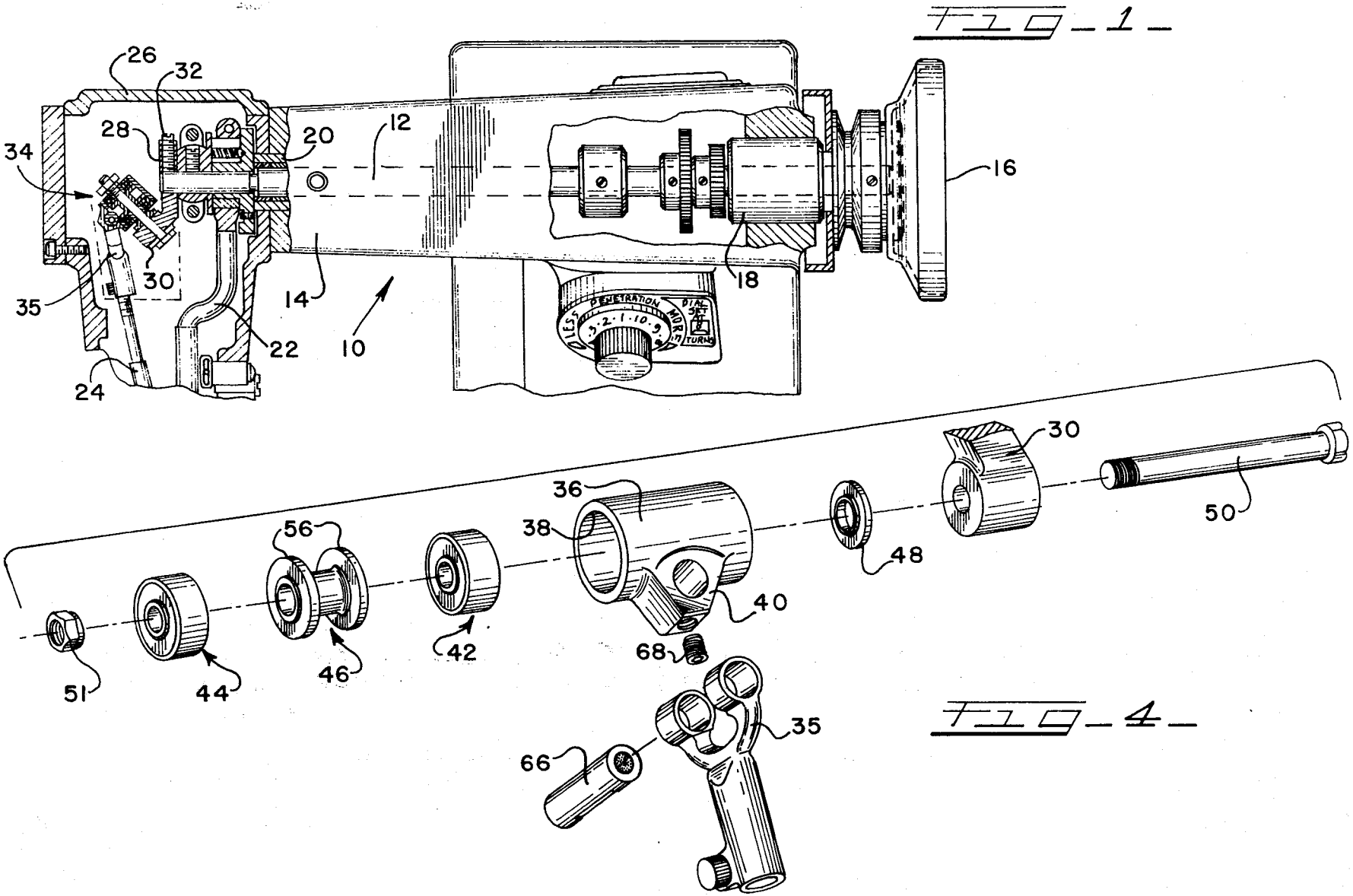
FIG. 1 is a view, partially in plane and partially in horizontal cross section, showing that portion of a blindstitch sewing machine which embodies the novel features of the invention.
FIG. 4 is an exploded view of the ball bearing force transfer means showing a portion of the looper drive crank and the looper link.

Referring now to the drawings and more particularly to FIG. 1, there is partially disclosed a blindstitch sewing machine. The general construction of the sewing machine 10 is more fully described in the previously mentioned patents to Roth and Mueller, and for details on the blindstitch machine reference should be made thereto. Thus, the sewing machine 10 will be discussed simply to set the environment for the ball bearing force transfer means which comprises the invention. A main drive shaft means 12 extends longitudinally of the upper arm structure 14 of the frame of the sewing machine at its arterial end. At the right, as shown in FIG. 1, the shaft 12 has secured thereto a combination handwheel and pulley means 16. Bearing sets 18 and 20 are also provided adjacent the right and left ends of the shaft 12.

The stitch forming mechanism of the blindstitch sewing machine includes a feed bar means 22, a node means (not shown), a looper rod means 24 being connected to a looper (not shown) and a housing means 26. Secured to the end of shaft means 12 is a counterweight means 28, having an angularly disposed crank arm portion 30. The counterweight means 28 being secured to the shaft means 12 by a set screw means 32. Transferring force between the angularly disposed crank arm 30 and the forked end 35 of the looper rod means 24 is the ball bearing force transfer means 34.

Figure 3:
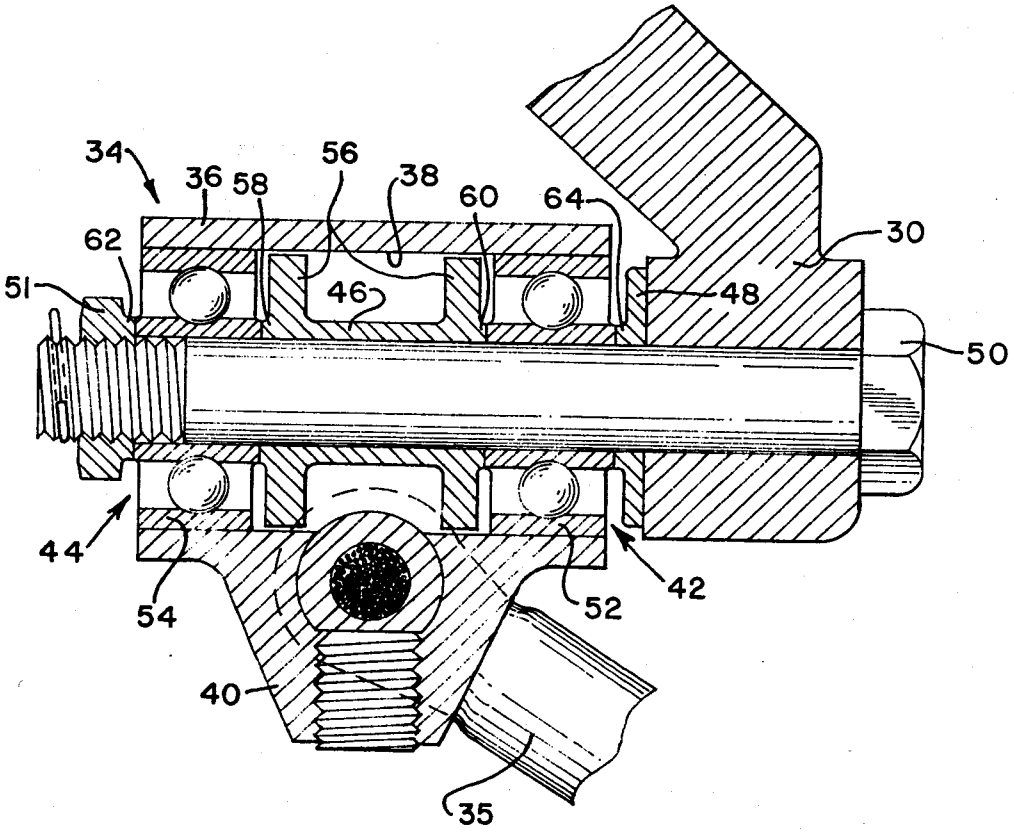
FIG. 3 is a cross-sectional view taken along line 3—3 of FIG. 2.
Figure 2:
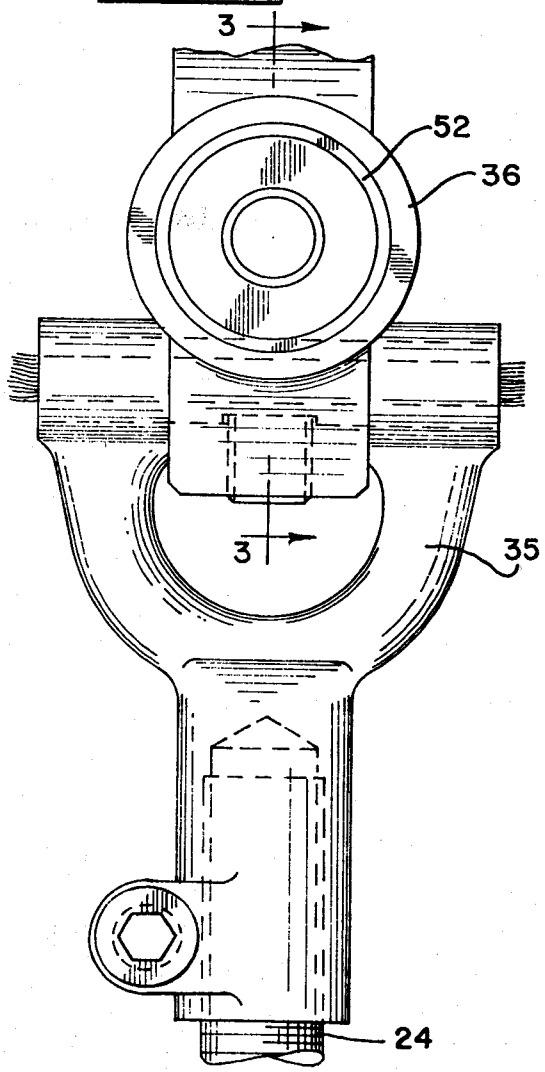
FIG. 2 is a partial end view of the ball bearing force transfer means and the looper link means.

Referring now to FIGS. 1, 3 and 4, the force transfer means 34 is shown in detail. As shown in FIG. 4, the force transfer means includes; a housing means 36 having a bore 38 and a means generally centrally positioned providing a connection 40, first and second bearing sets 42 and 44, a bearing spacer means 46, a washer means 48 and a nut and bolt means 50 and 51.

Referring now to FIG. 3, the manner of assemblage and the assemblage itself of the force transfer means 34 will be discussed. The outer race means 52 and 54 of both bearing sets 42 and 44 are press fit within the bore 38 of the housing 36. In practice, one or the other of the bearing sets is, as described, press fitted. Then the spacer means 46 is positioned within the bore and the other bearing is press fit into position. The spacer means 46 is provided with self-aligning means 56 which centrally locate it within the bore to facilitate assemblage. Also, shoulder means 58 and 60 are means suitably provided thereon, for engaging only the inner race of the respective bearing sets. It will be noted that the total diameter of the spacer means is slightly less than the diameter of the bore means 38, such that the assemblage can be freely positioned therein. Thus, the bearing set can be accurately horizontally disposed within the bore means 38, simply by press fitting the outer races inwardly until the inner races contact the shoulder portion of the spacer means 46. The bearing sets and the spacer means are now journaled by a nut and bolt means 50 and 51, a thrust washer 48 being positioned between the bearing means 42 and the looper drive crank 30. As is apparent, the nut and bolt means have a diameter such that it simply journals the bearing sets and spacer, there being no press fit or other engagement therebetween. As shown in FIG. 3, the nut means 51 and the thrust washer 48 are also provided with shoulder means 62 and 64 for complementary engagement with only the inner race means of the adjacent bearing set. Therefore, when the nut and bolt means are threadedly engaged, the inner race means of the two bearing sets 42 and 44 are securely clamped to the looper drive crank 30 by virtue of the series of butting shoulder means contacting the inner races.

By this method of providing force transfer between the looper drive crank 30 and the looper link means 35, a certain degree of freedom is provided. That is, the ball bearing sets move or compensate for any tiny discrepancies or forces generated by the assembly and thus prolong the life of the assemblage, cut down on noise, etc.

Forked end 35 of the looper rod 24 is secured to the centrally located projection means 40. It is held by a pin means 66 secured in position by a retaining screw 68.

The assemblage itself first includes press fitting one or the other of the bearing sets into the bore means by pushing on the outer race thereof until it is flush with the edge face of the housing 36. The spacer is then inserted through the other end of the housing and the other bearing set is pressed fit until the inner ring race means just contacts the spacer. This assemblage then, via the nut and bolt means and pin means, is secured respectively to the looper drive crank and the forked element 35 of the looper rod.

There has thus been described a force transfer means for delivering force from the looper drive crank to the looper rod of a blindstitch sewing machine. The force is transferred from the looper drive crank through a series of bearing sets in a force transfer means to the looper rod. The outer races of the bearing sets are press fitted to the housing of the forced transfer means, while the inner races are clamped by an abutting relationship to the looper drive crank. Thus, forces are transferred through the ball series of the ball bearing means without the aid of thrust bearings.

Thus it is apparent that there has been provided, in accordance with the invention, a Force Transfer Means that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. In a blindstitch sewing machine having a frame structure, a main rotary drive shaft and stitch forming mechanism including a looper carrying link adapted to be reciprocated longitudinally, turned angularly through a predetermined arc and tilted pivotally about at least one fulcrum, and force transfer means from said drive shaft for imparting all of such movements to said looper carrying link, said force transfer means comprising:

housing means having a horizontally extending bore means and a connection means generally centrally positioned thereon;

first and second ball bearing set means horizontally spaced apart in said bore means, adjacent the ends of said housing, and having the outer race means thereof secured to said housing means;

spacer means having a horizontally extending bore means positioned in said bore means between said first and second ball bearing set means, abutting only the inner race means thereof; and elongated shaft means journaling said ball bearing set means and said spacer means whereby said inner race means of said bearing set means, through said spacer means, are abuttingly lockable such that force transfer from said main rotary drive shaft to said looper carrying link means is through said ball bearing set means.

2. The blindstitch sewing machine of claim 1 wherein said looper carrying link includes a bifurcated means pivotally secured to said connection means generally centrally positioned on said housing.

3. The force transfer means of claim 1 wherein:

said elongated shaft means includes a nut and bolt means, said nut and bolt means include shoulder means having a diameter less than the inside diameter of said outer race means.

4. In a sewing machine having a drive shaft means and a stitch forming means including a looper carrying link wherein the improvement comprises:

a ball bearing looper driver means including;

a housing means having a bore means extending along the major axis thereof and an appendage means centrally located and extending generally perpendicular to said major axis and being secured to said looper carrying link;

first and second ball bearing set means having inner and outer race means spaced apart in said bore means, said outer race means being secured to said housing means;

spacer means carried within said housing, between said first and second set means in an abutting relationship with said inner race means;

shaft means having spaced apart facing shoulder means for locking in an abutting relationship said inner race means to said drive shaft means whereby force is transferred from said drive shaft means to said looper carrying link means through said bearing set means.

5. The improvement of claim 4 wherein said spacer means includes:

alignment means for positioning said spacer means within said housing means.

* * * * *